United States Patent [19]

Bundy et al.

[11] 3,942,712

[45] Mar. 9, 1976

[54] CARTON HAVING HINGED HOODED COVER

[75] Inventors: Patrick L. Bundy; Ross R. Harrison, both of Battle Creek, Mich.

[73] Assignee: Michigan Carton Company, Battle Creek, Mich.

[22] Filed: Aug. 9, 1974

[21] Appl. No.: 496,116

[52] U.S. Cl. ..... 229/51 TC; 229/44 R; 229/45 R

[51] Int. Cl.[2] ..... B65D 5/54; B65D 5/66

[58] Field of Search ..... 229/44 R, 44 CB, 51 TC, 229/45

[56] References Cited

UNITED STATES PATENTS

| | | | |
|---|---|---|---|
| 1,374,956 | 4/1921 | Schneider | 229/44 CB |
| 3,190,537 | 6/1965 | Meinecke et al. | 229/45 |
| 3,282,492 | 11/1966 | Vergobbi | 229/44 CB |
| R26,471 | 10/1968 | Meyers | 229/51 TC |

*Primary Examiner*—William Price
*Assistant Examiner*—Douglas D. Farrow
*Attorney, Agent, or Firm*—Woodling, Krost, Granger & Rust

[57] ABSTRACT

A carton is provided having a hinged reclosable hooded cover, and recess means provided in the upper corners connecting the front wall panel to the side wall panels to provide relief for the upper body portion of the carton when the cover is closed, thereby preventing bowing or other distortion thereof.

18 Claims, 6 Drawing Figures

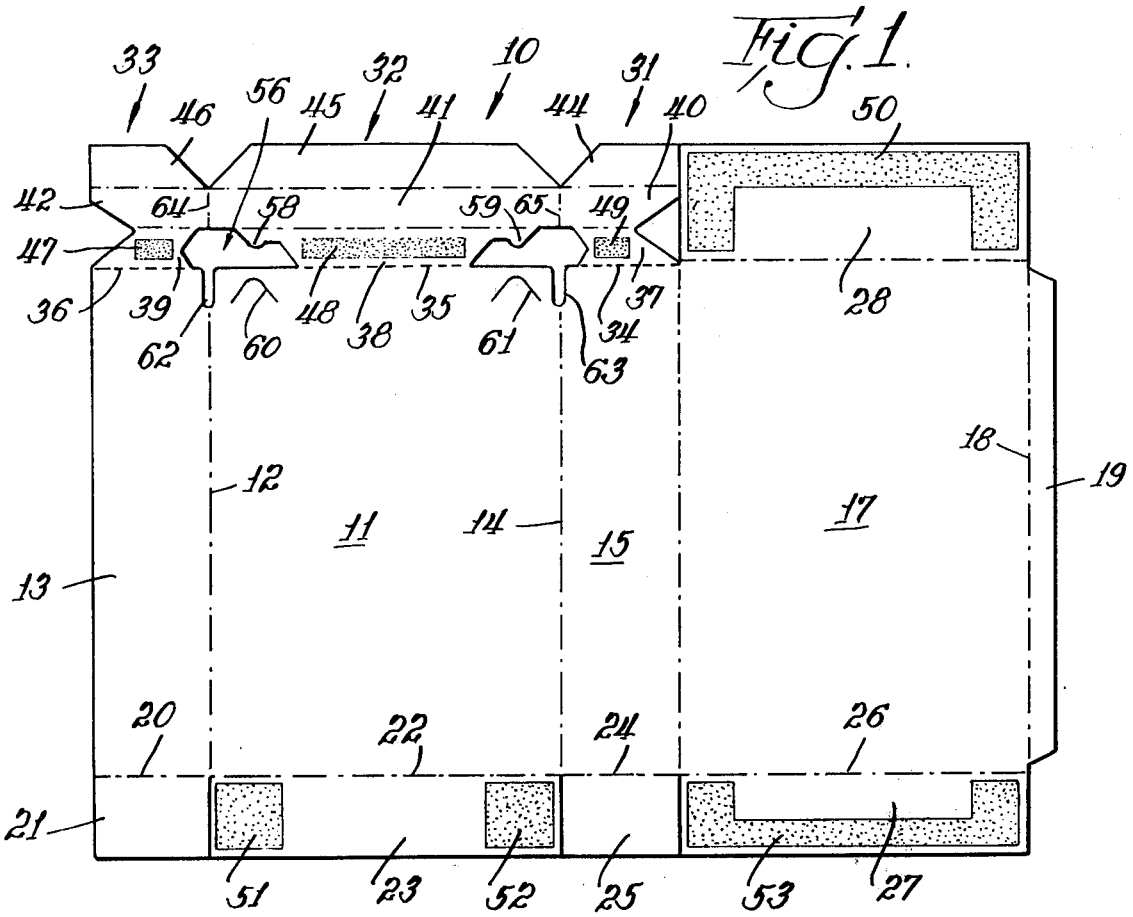
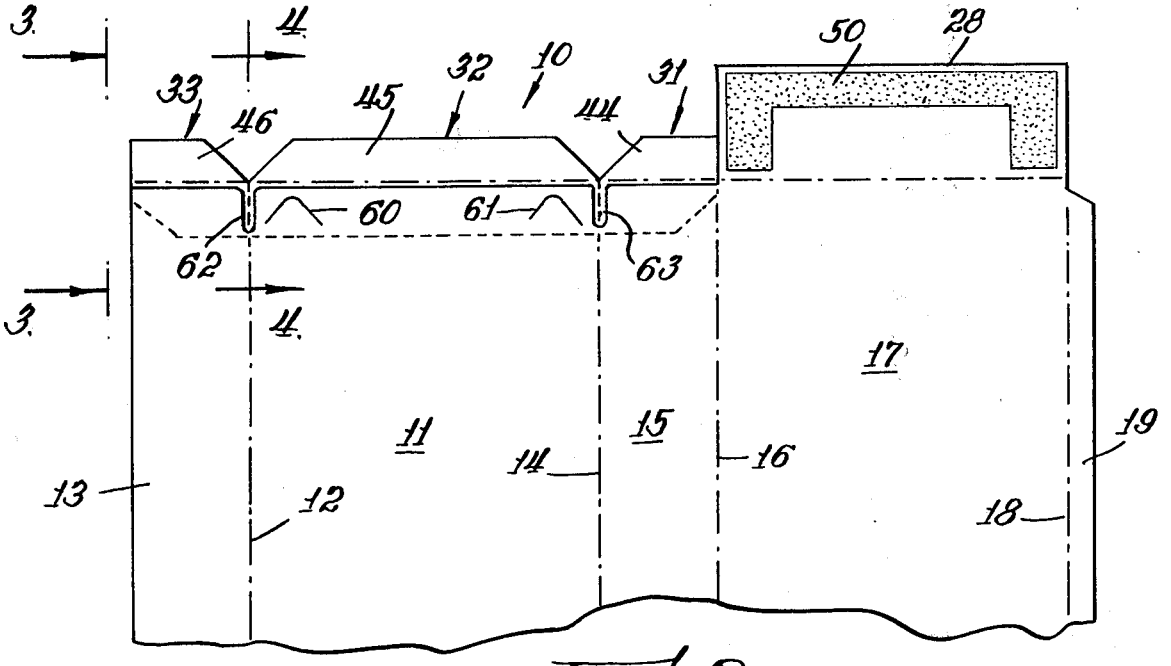
Fig. 2.

Fig. 3.
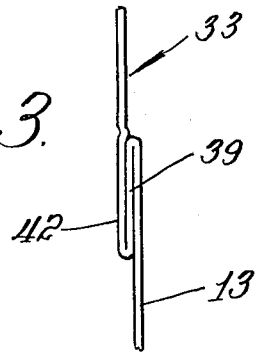
Fig. 4.
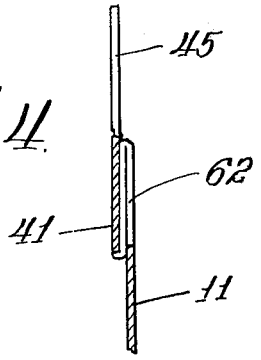
Fig. 5.
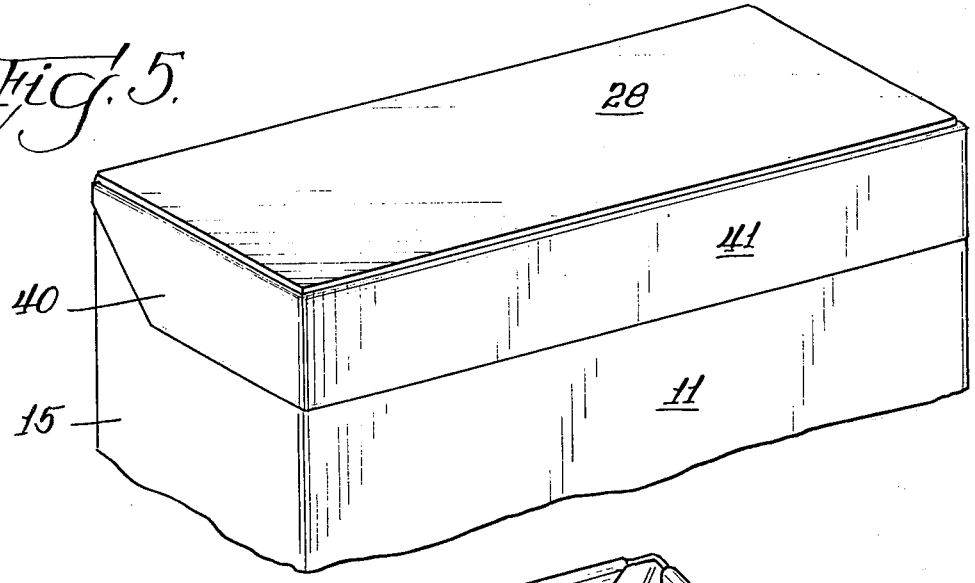
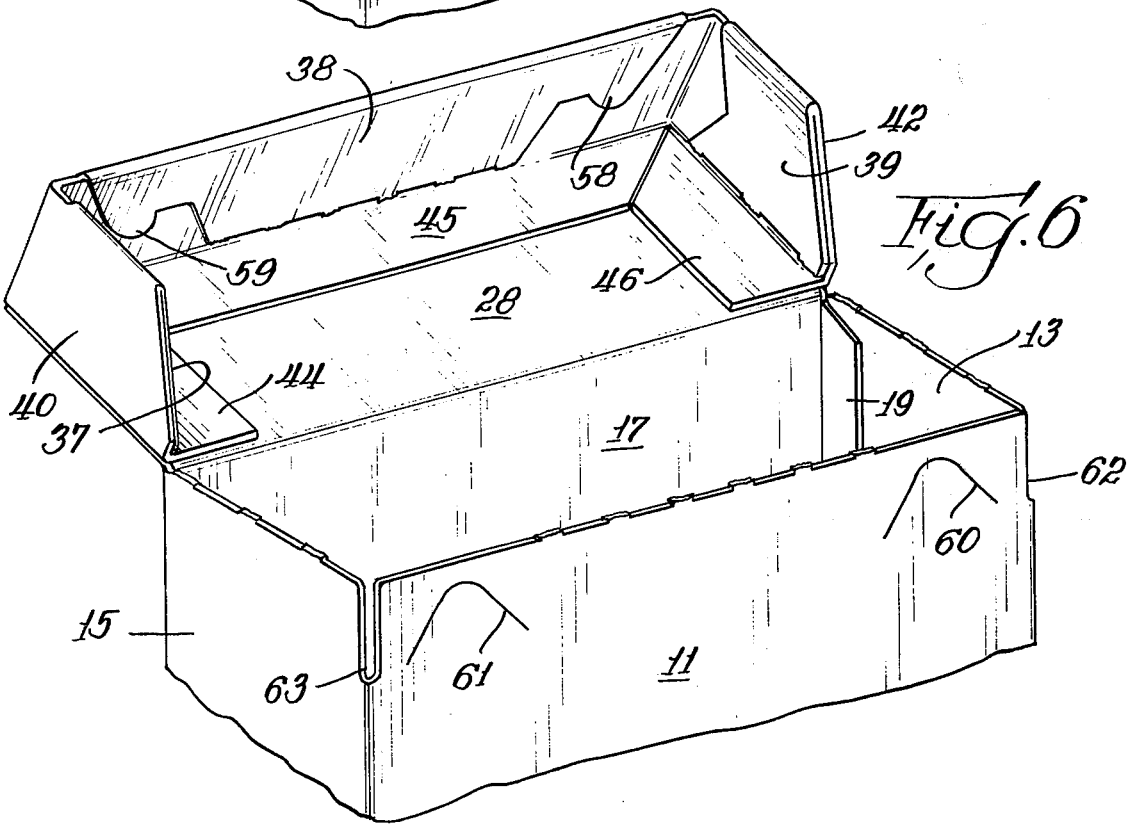
Fig. 6

CARTON HAVING HINGED HOODED COVER

BACKGROUND OF THE INVENTION (1) Field of Invention

The present invention relates to cartons and is more particularly concerned with a sealed carton having a hinged hooded cover which may be opened and subsequently reclosed.

(2) Prior Art

Cartons formed of paper board and comprising a body portion and a hooded cover adapted to be opened and reclosed are well-known in the art. Additionally, cartons have been disclosed which have means for locking the cover or hood in place once the seal has been broken and the cover opened. Additionally, cartons of the type described have been disclosed having outward displacement of the sources of the hood of the cover in order to clear the inner layer of the hood. However, such cartons of the prior art have still been troubled with distortion of the upper part of the body portion of the carton when the hood of the cover is closed over the upper edges of the side walls and front wall.

SUMMARY OF THE INVENTION

Accordingly, it is an object of the present invention to provide a carton having a hinged hooded cover which may be readily opened and reclosed.

It is an additional object to provide an improved carton which can be readily fabricated and assembled on standard high speed packaging equipment.

It is another object to provide a carton having a structure permitting the hooded cover to be closed over the body of the carton without causing distortion of the carton.

Still further objects and advantages of the invention will appear from the following description and drawings.

According to the invention a hooded carton is provided comprising a body portion formed of a bottom, rear wall, side walls, and front walls, and a hinged hooded reclosable cover. Additionally, recesses or notches and provided at the upper corners between the front wall panel and side wall panels at a depth substantially equal to that of the hood of the carton but preferably a small amount shorter, so that when the cover is closed, the recesses are covered or obscured. The recesses provide sufficient relief when the cover is closed to permit the side wall panels and front wall panel to be displaced slightly inward within the cover without causing substantial distortion or bowing.

BRIEF DESCRIPTION OF THE DRAWINGS

In the annexed drawings:

FIG. 1 is a plan view of a blank for forming the carton of the present invention.

FIG. 2 is a fragmentary plan view of the blank as shown in FIG. 1, but after the hood has been folded over.

FIG. 3 is a fragmentary end view of the blank taken at the line 3—3 of FIG. 2, looking in the direction of the arrows.

FIG. 4 is a fragmentary cross-sectional view taken at the line 4—4 of FIG. 2, looking in the direction of the arrows.

FIG. 5 is a fragmentary perspective view of the carton with the cover closed, and FIG. 6 is a fragmentary perspective view of the carton with the cover open.

DESCRIPTION OF THE PREFERRED EMBODIMENTS

Referring to FIG. 1, an integral blank 10 as shown suitable cut and scored to form a carton according to the invention. The blank includes a front wall panel 11 connected by a hinge score line 12 to a side wall panel 13 and by another hinge score line 14 to another side wall panel 15, which in turn is connected by a hinge score line 16 to a rear wall panel 17. A hinge score line 18 connects the rear wall panel 17 to a glue flap 19.

The carton bottom is formed of a plurality of end flaps. The side wall panel 13 is connected by a hinge score line 20 to a side wall end flap 21, the front wall panel 11 is connected by a hinge score line 22 to a front wall end flap 23, the side wall panel 15 is connected by means of a hinge score line 24 to a side wall end flap 25, and the rear wall panel 17 is connected by a hinge score line 26 to a rear wall end flap 27.

The cover is formed by a cover panel 28 hingedly connected to the rear wall panel 17, and by hinged together sections including an end wall cover section 31, a front wall cover section 32, and an end wall cover section 33. The end wall cover section 31 is connected to the side wall panel 15 by means of a perforated fracture line 34, the front wall cover section 32 is connected to the front wall panel 11 by means of a perforated fracture line 35, and the end wall cover section 33 is connected to the side wall panel 13 by a perforated fracture line 36. The end wall cover section 31, front wall cover section 32 and end wall cover section 33 include inner hood panels 37, 38, and 39, respectively, outer hood panels 40, 41, and 42. Hingedly connected to the outer hood panels 40, 41, and 42 are cover panel engaging flaps 44, 45, and 46. Glue areas 47, 48, 49, 50, 51, 52 and 53 are provided for assembling the carton. Cut-outs 56 and 57 are provided for relieving strains on the carton, and also for defining lock tabs 58 and 59 adapted to engage V-shaped slits 60 and 61 adapted to engage the tabs 58 and 59 when the carton is assembled and the cover reclosed.

According to the invention, recesses or slots 62 and 63 are provided at the upper corners of the hinged score lines 12 and 14 at the corners of the front wall panel 11 and the side wall panels 13 and 15. The recesses 62 and 63 permit the corners or hinge lines 64 and 65 of the outer hood panels 40, 41 and 42 to recess therein, and additionally serve to relieve stresses created by the placing of the double layer cover over the edges of the carton panels. They also permit the upper edge of the front wall panel 11 and side wall panels 13 and 15 to move inwardly when the cover is placed thereover. The length of the recesses 62 and 63 should be a major proportion of the width of the cover walls, that is, the width of the walls formed by the folding over of the outer hood panels 40, 41 and 42 over the inner hood panels 37, 38 and 39. Preferably the recesses should be almost equal to the width of the outer hood or cover panels in order to provide as much relief as possible, but for the sake of appearance, should be just slightly shorter, so that when the carton is assembled, the outer hood or cover panels 40, 41 and 42 hide or obscure the recesses.

In assembling the carton of the invention from the blank shown in FIG. 1, the end wall cover sections 31, 32 and 33 are folded over and then the outer hood panels 40, 41 and 42 folded over and glued to the inner hood panels 37, 38 and 39, as shown in FIG. 2. The glue panel 19 is then glued to the side wall panel 13, in which condition the carton is folded flat and may be stacked and shipped. To erect the carton, the panels are squared up and the side wall end flaps 21 and 25 folded up and the end flaps 23 and 27 folded in place and glued. The carton is then filled and the cover panel engaging flaps 44, 45 and 46 are folded over and the cover panel 28 is folded over and glued to the cover panel engaging flaps 44, 45 and 46. FIG. 5 illustrates the carton in completely assembled form. In the assembled form the recesses 62 and 63 receive the corners of the cover and permit the upper edges of the carton body to be moved inwardly by the cover, thereby preventing bowing or other distortion of the closed carton.

FIG. 3 illustrates the end portion of the folded blank.

FIG. 4 illustrates the relationship of the corners of the front wall panel 11 and the recesses 62 and 63.

In opening the carton, the hood is grasped at the front wall panel 11 and lifted up, tearing the perforated fracture lines 34, 35 and 36, the open structure being shown in FIG. 6. The carton is reclosed by flipping the cover 28 back so that the hood covers the edge of the side wall panels and front wall panel. When the hood is in closed position, the tabs 58 and 59 engage the V-slots 60 and 61 and prevent the carton from opening spontaneously. The cover may be reopened by grasping and forcing the tabs out of the V-slots.

The carton of the present invention has several advantages over prior art cartons. First, by providing the slots or recesses in the upper corners of the body of the carton space is provided for nesting the corners of the hood or cover side walls therein without forcing the corner of the front panel outwardly. Additionally, the corner recesses provide freedom or relief so that if there should be any forces tending to bow the upper portion of the front wall panel or side wall panels, the relief so provided permits the upper margins of the panels to more inwardly, thereby permitting the hood to slide thereover easily and without setting up stress in any direction. The structure obviates the need for displacing the score lines of the hood outwardly to clear the carton body, an expedient that increases the complexity of the cutting and scoring of the carton blank.

It is to be understood that the invention is not to be limited to the exact details of operation or structure shown and described in the specification and drawings, since obvious modifications and equivalents will be readily apparent to one skilled in the art.

The embodiments of the invention in which an exclusive property or privilege is claimed are defined as follows:

1. A carton comprising:

1. a body portion having a front wall panel, a rear wall panel, side wall panels, and a bottom panel,
2. a reclosable cover comprising
   a. a cover top panel hingedly connected to the rear edge of said rear wall panel,
   b. a cover front wall panel connected to said cover top panel, and
   c. a pair of cover side wall panels connected to said cover front wall panel and said cover top panel, and
3. a recess provided at the upper portion of each corner between said front wall panel and said side wall panels of the body of said carton, each said recess having spaced apart sides and extending from an upper marginal edge of said panels thereinto a given length, the length of said recesses being a substantial proportion of the width of said cover front wall and said cover side walls, thereby relieving stress caused by the overlapping of said cover over the top of the body portion of said carton when said cover is closed.

2. A carton according to claim 1, wherein the length of said recesses is substantially the same as the width of said cover front wall panel and said cover side wall panels.

3. A carton according to claim 1, wherein the length of said recesses is smaller than the width of said cover front wall and said cover side walls, whereby said cover front wall panel and cover side wall panels obscure said recesses when said cover is closed.

4. A carton according to claim 1, wherein said cover and the upper portion of said body portion are provided with cooperating locking means.

5. A carton according to claim 1, wherein said cover is comprised of inner cover front wall and side wall panel members connected to said carton front wall panel and side wall panel members hingedly connected to said inner cover wall members and adhesively affixed thereto, and glue flaps hingedly connected to said outer cover front and side wall panel members and adhesively affixed to said cover top panel.

6. A carton according to claim 5, wherein said fracture lines are substantially coplanar.

7. A carton according to claim 5, wherein the length of said recesses is substantially the same as the width of said cover front wall and cover side wall panel members.

8. A carton according to claim 5, wherein the length of said recesses is smaller than the width of said cover front and side wall panel members, whereby said cover front wall and side wall panel members obscure said recesses when said cover is closed.

9. A carton according to claim 5, wherein said cover and the upper portion of said body portion are provided with cooperating locking means.

10. A blank suitably cut and scored for forming a carton comprising:

1. a front wall panel, a rear wall panel, side wall panels, and bottom end flaps adapted to form a body portion,
2. means adapted to form a reclosable cover comprising:
   a. a cover top panel hingedly connected to the rear edge of said rear wall panel,
   b. a cover front wall panel connected to said cover top panel, and
   c. a pair of cover side wall panels connected to said cover front wall panel and said cover top panel, and
3. a recess provided at the upper portion of each corner between said front wall panel and said side wall panels of the body of said carton, each said recess having spaced apart sides and extending from an upper marginal edge of said panels thereinto a given length, the length of said recesses being a substantial proportion of the width of said cover front wall panel and said cover side walls, thereby relieving stress caused by the overlapping of said cover over the top of the body portion of said carton when said carton is erected and said cover is closed.

11. A blank according to claim 10, wherein the length of said recesses is substantially the same as the width of said cover front wall panel and said cover side wall panels.

12. A blank according to claim 10, wherein the length of said recesses is smaller than the width of said cover front wall and said cover side walls, whereby said cover front wall panel and cover side wall panels obscure said recesses when said cover is closed.

13. A blank according to claim 10, wherein said cover and the upper portion of said body portion are provided with cooperating locking means.

14. A blank according to claim 10, wherein said cover is comprised of an inner cover front wall member hingedly connected to said front wall panel, an outer cover front wall member hingedly connected to said inner cover front wall member, and a cover top panel glue flap hingedly connected to said outer cover front wall member and adapted to be adhesively affixed to said cover top panel, and wherein inner cover side wall members are hingedly connected to said side wall panels, outer cover side wall members are hingedly connected to said inner cover side wall members, and glue flaps are hingedly connected to said outer cover side wall members and adapted to be adhesively affixed to said cover top panel.

15. A blank according to claim 14, wherein the length of said recesses is substantially the same as the width of said cover side panel members and cover front panel members.

16. A blank according to claim 10, wherein the length of said recesses is substantially the same as the width of said cover front wall and cover side wall panel members.

17. A blank according to claim 10, wherein the length of said recesses is smaller than the width of said cover front and side wall panel members, whereby said cover front wall and said wall panel members obscure said recesses when said cover is closed.

18. A blank according to claim 10, wherein said cover and the upper portion of said body portion are provided with cooperating locking means.

* * * * *